United States Patent [19]

Iwata et al.

[11] 4,335,970

[45] Jun. 22, 1982

[54] TYPE WHEEL FOR SERIAL PRINTING APPARATUS

[75] Inventors: Nobuo Iwata; Takami Suzuki, both of Tokyo, Japan

[73] Assignee: Ricoh Company, Ltd., Tokyo, Japan

[21] Appl. No.: 162,563

[22] Filed: Jun. 24, 1980

Related U.S. Application Data

[63] Continuation of Ser. No. 943,266, Sep. 15, 1978, abandoned, which is a continuation of Ser. No. 792,157, Apr. 29, 1977, abandoned.

[30] Foreign Application Priority Data

May 1, 1976 [JP] Japan ..... 51-49399

[51] Int. Cl.[3] ..... B41J 1/26

[52] U.S. Cl. ..... 400/144.2; 101/93.19; 400/174

[58] Field of Search ..... 101/93.19; 400/144.1-144.4, 174, 175

[56] References Cited

U.S. PATENT DOCUMENTS

| | | | |
|---|---|---|---|
| 3,202,257 | 8/1965 | Rihm | 400/466 |
| 3,640,369 | 2/1972 | Rolph | 400/145.2 |
| 3,643,774 | 2/1972 | Kondur | 400/144.3 |
| 3,651,916 | 3/1972 | Becchi | 400/144.3 |
| 3,677,386 | 7/1972 | Herterich et al. | 400/144.2 |
| 3,773,160 | 11/1973 | Rava et al. | 400/466 |
| 4,084,680 | 4/1978 | Deetz | 400/144.2 X |

FOREIGN PATENT DOCUMENTS 2430292 1/1975 Fed. Rep. of Germany ... 400/144.2

*Primary Examiner*—Paul T. Sewell

*Attorney, Agent, or Firm*—Jordan and Hamburg

[57] ABSTRACT

Each of resilient tongues of a type wheel for use in a serial printing apparatus carries one or more type members. Each of the type members is provided with a curved or concave type face whose center of curvature lies on an axis of a paper supporting platen so that the type face comes into even and tight contact with the platen surface in a printing position. The curved type face is formed on a projection having a forward end which is tapered toward or away from a plane perpendicular to a rotary axis of the type wheel. Further, the each of the type members is provided with a back face which is formed on a back portion of the curved type face. The back face is driven by a hammer which is oriented in a predetermined direction toward the axis of the platen so as to be evenly and entirely engaged with a striking face of the hammer in the printing position. The back portion of the curved type face comprises a projection which is tapered toward or away from a plane perpendicular the rotary axis of the type wheel. The back face is so inclined as to be parallel to a direction perpendicular to the predetermined direction of the hammer in the printing position.

12 Claims, 8 Drawing Figures

TYPE WHEEL FOR SERIAL PRINTING APPARATUS

This is a continuation of application Ser. No. 943,266, filed Sept. 15, 1978, now abandoned, said Ser. No. 943,266 being a continuation of application Ser. No. 792,157, filed Apr. 29, 1977, now abandoned.

The present invention relates in general to a serial printing apparatus and, more particularly, to an improved type wheel having resilient tongues each carrying one or more type members.

In the type of a serial printer using a type wheel, as exemplified by our copending U.S. patent application Ser. No. 644,987 filed Dec. 29, 1975, a rotary type wheel comprises one or more rotary hubs. Resilient tongues extend radially from the hub and carry radially outer type members and radially inner type members. The rotary hub is rotated until the tongue carrying the type member formed with a desired character for printing is in a printing position facing a platen which supports paper. A hammer then drives the type member against the paper through an inked ribbon to print the character on the paper resiliently deforming the tongue in the process.

In the serial printing apparatus of this type, however, since the outer type members and the inner type members on each tongue are positioned at different distances from the rotary hub to the centers of the outer and inner type members, the tongue is differently bent or deformed toward the platen when the outer type members and the inner type members are respectively driven by the hammer in the printing position, causing type faces of the outer and inner type members to come into uneven and insufficient contact with the platen surface. In addition, the same impact may not be uniformly applied to both the outer and inner type members when driven by the hammer against the paper to print, because the hammer is always oriented in one predetermined direction toward an axis of the platen. In other words, a striking face of the hammer is not evenly and entirely engaged with back faces of the type members at the moment of the striking of characters, resulting in deterioration in the quality of printing.

Thus, there is a continuing need for an improved type wheel for a serial printing apparatus.

It is, therefore, an object of the present invention to provide an improved type wheel for use in a serial printing apparatus overcoming the above problem.

The present invention will be described with reference to the accompanying drawings in which.

Figure 1:
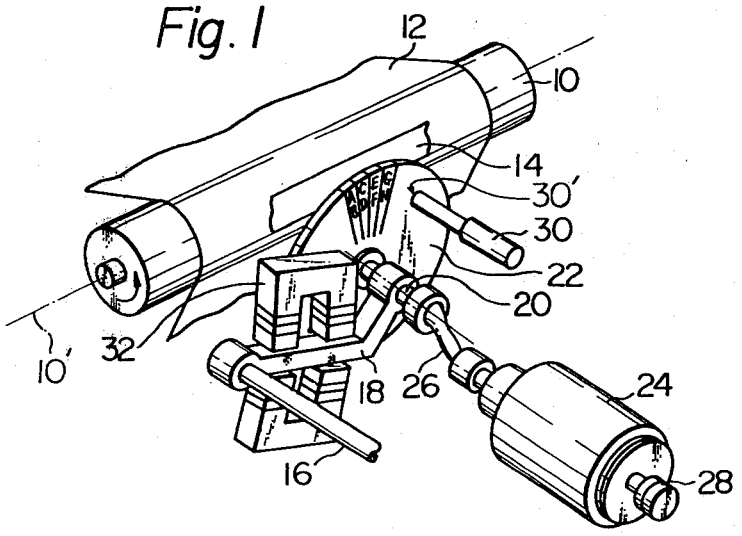
FIG. 1 is a plan view of a serial printing apparatus to which the present invention is applicable.

Referring now to FIG. 1, a serial printing apparatus to which the present invention is applicable comprises a rotary platen 10 having a rotary axis 10' and supporting a paper 12 on which information is to be printed by the printing apparatus. An inked ribbon 14 is located in front of the paper 12. A carriage which is not shown supports a shaft 16 which rotatably supports an arm 18. The arm 18 rotatably carries at its end a shaft 20 to which is fixed a type wheel 22. The carriage also supports a rotary drive motor 24, which is connected to the shaft 20 by a universal joint 26. A sensor device 28 is provided to control the motor 24. A hammer 30 having a striking face 30' is movable with the carriage and is actuated by a mechanism which is not shown. The hammer 30 is oriented in a predetermined direction toward the axis 10' of the platen 10. An electromagnet 32 is also movable with the carriage to rotate the arm 18 about the shaft 16 as desired.

Figure 2:
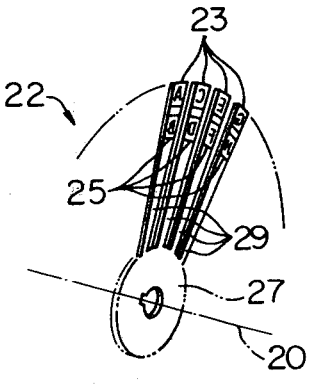
FIG. 2 is a fragmentary plan view of a type wheel for use in the serial printing apparatus shown in FIG. 1.

Referring now to FIG. 2, the type wheel 22 comprises a rotary hub 27 which is fixed to the shaft 20. Resilient tongues 29 extend radially from the hub 27 and carry radially outer type members 23 and radially inner type members 25. The type members 23 and 25 are formed with type faces to print characters. In a typical application, the inner type members 25 may be formed with the upper case Roman alphabet characters and the outer type members 23 may be formed with the lower case Roman alphabet characters. The resilient tongues may be formed of a thermoplastic resin containing glass or carbon fibers, and the type members may be formed separately from the tongues, fixed thereto and plated with metal.

In operation, the carriage is moved along the axis 10' of the platen 10 by a carriage drive means (not shown) so that the shaft 16, arm 18, electromagnet 32, shaft 20, type wheel 22, motor 24, universal joint 26, sensor device 28 and hammer 30 are moved as a unit. The carriage is stopped at each printing position to print a character. In an application in which the motor 24 is stepping motor or a servomotor, a character to be printed is selected by a keyboard (not shown) or similar device which sends a rotational signal to the motor 24 and a shift signal to the electromagnet 32. The motor 24 utilizing the sensor device 28 rotates the shaft 20 until the tongue 29 containing the type member with the selected character is in an angular printing position adjacent to the ribbon 14. The electromagnet 32 is energized to attract and rotate the arm 18, shaft 20, and type wheel 22 so that the desired type member 23 or 25 on the selected tongue 29 is in a linear printing position (if the length of the arm 18 is long compared with the spacing between the type members 23 and 25, this movement of the shaft 20 is approximately linear). The hammer 30 is then actuated to drive the selected type member 23 or 25 against the inked ribbon 14 and paper 12 to print the character on the paper 12. It will be noticed that the selected tongue 29 is resiliently bent toward the paper 12 during this process.

The apparatus may be operated in another manner. The motor 24 may be rotated at constant speed and the hammer 30 actuated when the sensor device 28 senses that the selected tongue 29 is in the printing position. In this case, the hammer 30 holds the type member 23 or 25 against the ribbon 14 for a short time so that the tongue 29 must deflect in the rotational direction of the type wheel 22.

Figure 3:
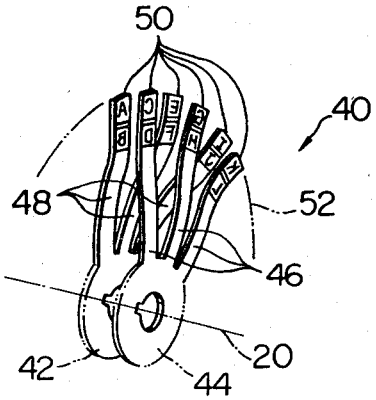
FIG. 3 is similar to FIG. 2 but shows another type wheel.

FIG. 3 shows another type wheel 40 which comprises two hubs 42 and 44 which are fixed to the shaft 20. Resilient tongues 46 radially extend from the hub 44 and resilient tongues 48 radially extend from the hub 42. Type members which are all designated as 50 are provided on the tongue 46 and 48 so that they all lie in a common plane 52 which is perpendicular to the axis of the shaft 20. The type wheel 40 is used in the same manner as the type wheel 22.

Whereas the serial printing apparatus of this kind is highly advantageous compared to a ball, cylinder or multihead printer in many respects, it has an inherent drawback in which the type faces of the type members are liable to come into uneven contact with the platen surface when driven by the hammer at the moment of the striking of characters, as mentioned hereinbefore. Thus, the printing apparatus as shown in FIGS. 1 to 3 is inadequate.

In order to eliminate the above drawback, an improved printing apparatus employing a specific type wheel is provided according to the present invention.

Figure 4:
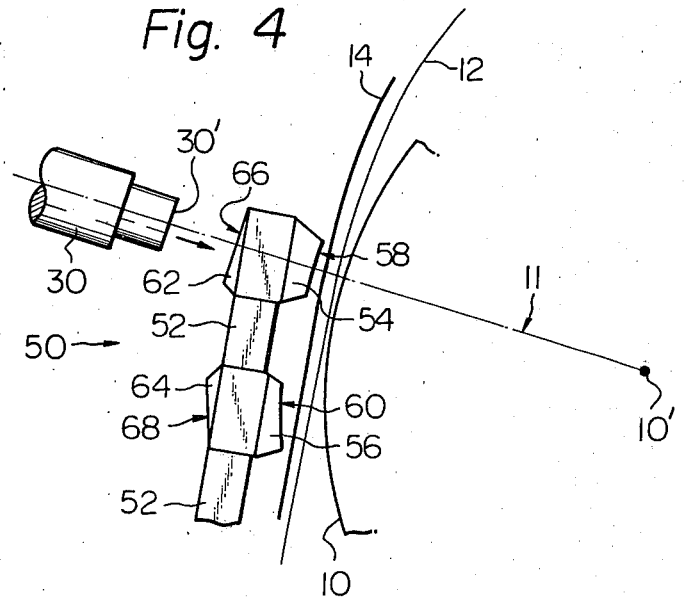
FIG. 4 is a fragmentary view of a first preferred embodiment of a type wheel according to the present invention.
Figure 5:
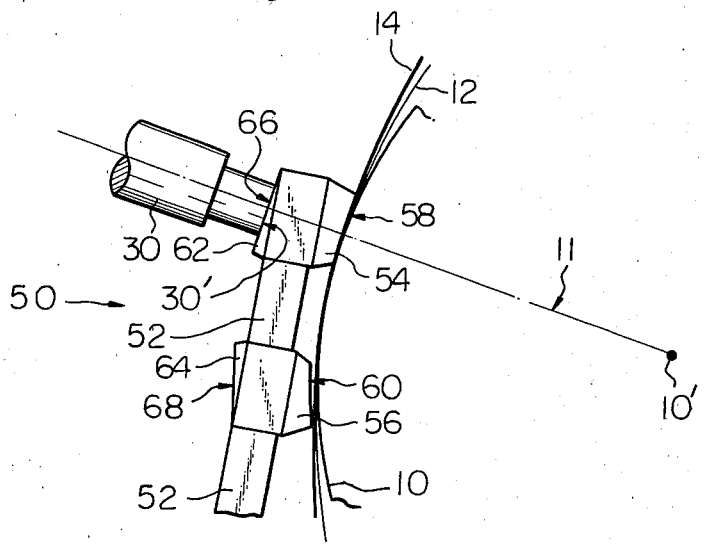
FIG. 5 is a fragmentary view similar to FIG. 4 but showing a radially outer type member of the type wheel in a printing position.
Figure 6:
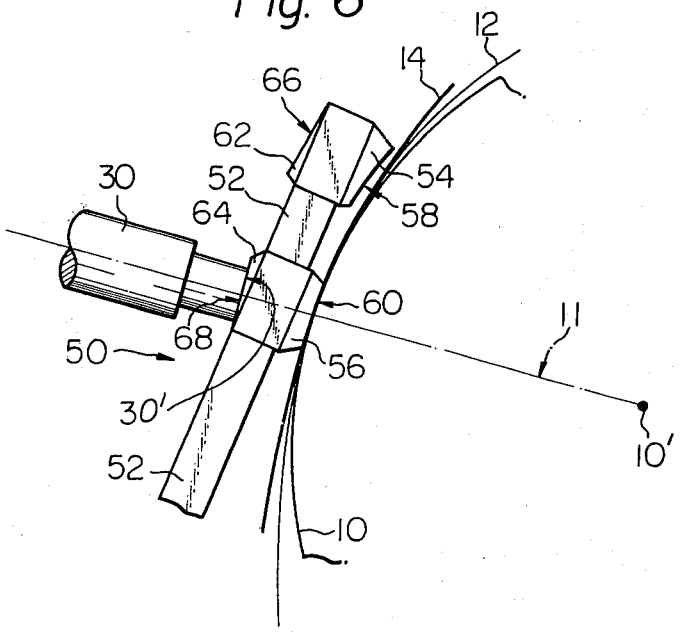
FIG. 6 is a fragmentary view similar to FIG. 5 but showing a radially inner type member of the type wheel in a printing position.

Referring is made to FIGS. 4 to 6 in which a preferred embodiment of a type wheel of the present invention is fragmentarily illustrated and is generally designated by a reference numeral 50. Though the type wheel 50 comprises a plurality of resilient tongues, only one tongue 52 is shown for the sake of simplicity. Further, a rotary platen, paper, inked ribbon and hammer are shown by the same designations as in FIG. 1.

The resilient tongue 52 carries a radially outer type member 54 and a radially inner type member 56. The outer and inner type members 54 and 56 are formed with curved or concave type faces 58 and 60 respectively. The center of curvature of each of the type faces 58 and 60 lies in or intersects the axis 10′ of the platen 10 in a printing position when the type members impact against the platen. As shown, the outer type member 54 includes a projection having a forward end which is tapered toward a plane which is perpendicular to the rotary axis of the tongue 52, while the inner type member 56 includes a projection having a forward end which is tapered away from the plane which is perpendicular to the rotary axis of the tongue 52.

On the other hand, projections 62 and 64 are provided on back portions of the curved type faces 58 and 60 respectively. Back faces 66 and 68 are formed on the projections 62 and 64 which are tapered away from and toward a plane perpendicular to the rotary axis of the tongue 52 respectively in a manner that the back faces 66 and 68 are so inclined as to be parallel to a direction perpendicular to the predetermined direction of the hammer in the printing position, that is, the back faces 66, 68 are parallel to planes which are tangential to the platen at the point of impact. It is to be appreciated that the inclination of the back face 66 of the projection 62 is opposite in direction to that of the projection 64. This is because the distances from a rotary axis of the type wheel 50 to the center of the outer and inner type members 54 and 56 are different from each other and therefore the tongue 52 is bent or deformed toward the paper 12 in different ways at the moment of the printing of characters, and further because the hammer 30 is always driven in the same direction, that is, along a line 11 directed toward the center 10′ of the platen 10, irrespective of the position of a selected type member.

FIG. 5 depicts the outer type member 54 which is in the printing position and driven by the hammer 30 to print character carried thereon on the paper 12. As shown, the curved or concave type face 58 of the type member 54 comes into tight contact with the platen surface through the ribbon 14 and the paper 12, while the back face 66 of the projection 62 thereof is evenly and entirely engaged with the striking face 30′ of the hammer 30.

FIG. 6 shows the inner type member 56 which is in the printing position and driven by the hammer 30 to print character carried thereon on the paper 12. As shown, the curved or concave type face 60 of the type member 56 is tightly pressed against the platen surface through the ribbon 14 and the paper 12, while the back face 68 of the projection 64 thereof is evenly and entirely engaged with the striking face 30′ of the hammer 30.

Figure 7:
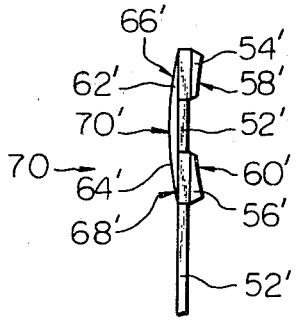
FIG. 7 is a fragmentary view of a modified embodiment of the type wheel shown in FIGS. 4 to 6.

It is noticeable that the projections 62 and 64 may be combined with each other in a unitary manner for convenience of manufacture, as shown in FIG. 7, in which a combined projection 70 comprises a projection 62′ corresponding to the projection 62, projection 64′ corresponding to the projection 64 and a flat or slightly concave or convex intermediate portion 70′. Back faces 66′ and 68′ corresponding to the back faces 66 and 68 are provided with predetermined inclinations respectively.

Figure 8:
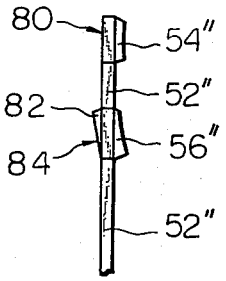
FIG. 8 is a fragmentary view of another modified embodiment.

If the apparatus is so designed that a flat back tongue surface 80 is evenly engaged with the striking face 30′ of the hammer 30 in a printing position, a projection 82 formed with a back face 84 may be provided on the back portion of an inner type member 56″ alone, as shown in FIG. 8. If desired, a projection may, of cource, be provided on the back portion of an outer type member 54″ alone.

Many modifications to the type wheels shown will be possible for those skilled in the art without departing from the scope of the invention after receiving the teaching of the present disclosure.

What is claimed is:

1. A rotary type wheel for use in a serial printing apparatus of the type in which a hammer is linearly operable along a fixed longitudinal axis to bend selected resilient tongues of the rotary type wheel to impact against a generally cylindrical paper supporting platen with said longitudinal fixed axis intersecting the axis of said cylindrical platen, the combination wherein the rotary type wheel comprises:

a rotary hub means having a rotary axis, the rotary hub means being rotatable and shiftable to a printing position;

a plurality of resilient tongues extending from the rotary hub means and being disposed in a common plane perpendicular to the axis of the rotary hub means when not impacting against the platen by the hammer, each tongue carrying at least two type members and being bent toward the platen at different angles when the two type members are respectively driven by the hammer in the printing position;

a first type member of said at least two type members provided on the tongue at a first radial distance from the rotary axis; and a second type member of said at least two type members provided on the tongue at a second radial distance from the rotary axis which is greater than the first radial distance from the rotary axis;

the first and second type members each having generally flat back faces which are adapted to be selectively contacted by the hammer to impact against the platen;

the first back faces of the first and second type members being disposed in different planes which intersects one another, neither of which is parallel to the common plane, such that the flat back faces of the first and second type members, upon impact of the respective type member against the platen as said type member is struck by said linearly operable hammer, are respectively disposed in first and second planes, either of which is substantially perpendicular to the fixed operable axis of the hammer, each tongue being bent toward the platen at first and second angles relative to the common plane when the first and second type members are respectively struck by the hammer in the printing position, the first angle being greater than the second angle, whereby the first and second type members are evenly impacted against the platen by the hammer.

2. A rotary type wheel according to claim 1, wherein the resilient tongues have projections on which the type members are formed, the projections having forward ends disposed in planes substantially parallel to the respective back face.

3. A rotary type wheel according to claim 1, wherein the plane of the back face of the first type member and the common plane intersect one another radially outwardly of the first type member, and the plane of the back face of the second type member and the common plane intersect one another radially inwardly of the second type member.

4. A rotary type wheel according to claim 1, wherein the first and second type members have forward ends, the forward end of the first type member being in a plane which intersects the common plane radially inwardly of the first type member, and the forward end of the second type member being in a plane which intersects the common plane radially outwardly of the second type member.

5. A rotary type wheel according to claim 1, wherein the platen has a generally cylindrical configuration and the fixed operable axis of the hammer intersects the axis of the cylindrical platen, the back faces of the first and second type members, upon impact of the respective type member against the platen, each being disposed in a plane parallel to a plane tangential to the platen at the point of impact of the respective type member against the platen.

6. A rotary type wheel according to claim 5, wherein each of the type members is formed with a curved type face having a radius of curvature substantially equal to the radius of the cylindrical platen, the curved type faces of the first and second type members being disposed on the respective tongues such that, upon impact of the respective type member against the platen, the center of curvature of the respective type member will intersect the axis of the platen.

7. A rotary type wheel according to claim 1, wherein each resilient tongue of the type member has a front face and a rear face, the first and second type members each being formed on projections projecting from the front face of the tongue, the back faces of the type members each being formed on projections projecting from the rear face of the tongue.

8. A rotary type wheel according to claim 1, wherein each resilient tongue of the type members has a front face and a rear face, at least one projection on the front face of the type member on which one of the type members is formed, at least one projection on the rear face of the tongue on which the back face of said one type member is formed, the one projection on which said one type member is formed having a forward end disposed in a plane parallel to the back face of said one type member.

9. A rotary type wheel for use in a serial printing apparatus of the type in which a hammer is operable along a fixed axis to bend selected resilient tongues of the rotary type wheel to impact against a paper supporting platen, the combination wherein the rotary type wheel comprises:

a rotary hub means having a rotary axis;

a plurality of resilient tongues extending from the rotary hub means;

first type members provided on the tongues at a first radial distance from the rotary axis;

second type members provided on the tongues at a second radial distance from the rotary axis;

each resilient tongue of the type member having a front face and a rear face, the first and second type members each being formed on projections projecting from the front face of the tongue, the back faces of the type members each being formed on projections projecting from the rear face of the tongue, and an intermediate projection joining the projections on which the back faces of the type members are formed;

the first and second type members each having back faces which are adapted to be selectively contacted by the hammer to impact against the platen;

the back faces of the first and second type members being disposed in different planes such that the back face of each type member, upon impact of the respective type member against the platen, is disposed in a plane perpendicular to the fixed operable axis of the hammer, whereby the first and second type members are evenly impacted against the platen by the hammer.

10. A rotary type wheel for use in a serial printing apparatus of the type in which a hammer is operable along a fixed axis to bend selected resilient tongues of the rotary type wheel to impact against a paper supporting platen, the combination wherein the rotary type wheel comprises:

a rotary hub means having a rotary axis;

a plurality of resilient tongues extending from the rotary hub means;

first type members provided on the tongues at a first radial distance from the rotary axis;

second type members provided on the tongues at a second radial distance from the rotary axis;

each resilient tongue having a front face and a rear face, the first and second type members each being formed on projections projecting from the front face of the tongue, one of the back faces being formed on a projection projecting from the rear face of the tongue, the other back face being coincident with the rear face of the tongue;

the first and second type members each having back faces which are adapted to be selectively contacted by the hammer to impact against the platen;

the back faces of the first and second type members being disposed in different planes such the the back face of each type member, upon impact of that respective type member against the platen, is disposed in a plane perpendicular to the fixed operable axis of the hammer, whereby the first and second type members are evenly impacted against the platen by the hammer.

11. A rotary type wheel for use in a serial printing apparatus of the type in which a hammer is linearly operable along a fixed longitudinal axis to bend selected resilient tongues of the rotary type wheel to impact against a generally cylindrical paper supporting platen with said longitudinal fixed axis intersecting the axis of said cylindrical platen, the combination wherein the rotary type wheel comprises:

a rotary hub means having a rotary axis, the rotary hub means being rotatable and shiftable to a printing position;

a plurality of resilient tongues extending from the rotary hub means and being disposed in a common plane perpendicular to the axis of the rotary hub means when not impacting against the platen by the hammer, each tongue carrying at least two type members and being bent toward the platen at different angles which the two type members are respectively driven by the hammer in the printing position;

a first type member of said at least two type members provided on the tongues at a first radial distance from the rotary axis; and a second type member of said at least two type members provided on the tongue at a second radial distance from the rotary axis which is greater than the first radial distance from the rotary axis;

the first and second type members each having forward ends disposed in planes which intersects one another;

the first and second type members each having generally flat back faces which are adapted to be selectively contacted by the hammer to impact against the platen;

the flat back faces of the first and second type members being disposed in different planes which intersects one another, neither of which is parallel to the common plane, the planes of the flat back faces of the first and second type members being substantially parallel to the forward ends of the first and second type members respectively, such that the flat back faces of the first and second type members, upon impact of the respective type member against the platen as said type member is struck by said linearly operable hammer, are respectively disposed in first and second planes, either of which is substantially perpendicular to the fixed operable axis of the hammer, each tongue being bent toward the platen at first and second angles relative to the common plane when the first and second type members are respectively struck by the hammer in the printing position, the first angle being greater than the second angle, whereby the first and second type members are evenly impacted against the platen by the hammer.

12. In a serial printing apparatus, the combination comprising:

a rotary type wheel having a plurality of resilient tongues;

a hammer mechanism having a hammer linearly operable along a fixed longitudinal axis to selectively impact said resilient tongues;

a generally cylindrical paper supporting platen against which said resilient tongues are impacted, said fixed longitudinal axis intersecting the axis of said cylindrical platen;

said rotary type wheel having a rotary hub means rotatable about a rotary axis;

said plurality of resilient tongues extending from said rotary hub means and being disposed in a common plane perpendicular to the axis of said rotary hub means when not impacting against said platen by said hammer, each tongue carrying at least two type members;

a first type member of said at least two type members being provided on the tongue at a first radial distance from the rotary axis;

a second type member of said at least two type members being provided on the tongue at a second radial distance from the rotary axis which is greater than the first radial distance from the rotary axis;

shiftable means for shifting said rotary type wheel between positions such that said first and second type members are selectively disposed generally aligned with said fixed longitudinal axis, and said first and second type members are bent toward said platen at different angles when said first and second type members are respectively driven by said hammer in the printing position;

said first and second type members each having generally flat back faces which are adapted to be selectively contacted by said hammer to impact against said platen;

said flat back faces of the first and second type members being disposed in different planes which intersect one another, neither of which is parallel to said common plane, such that said flat back faces of the first and second type members, upon impact of the respective type member against the platen as said type member is struck by said linearly operable hammer, are respectively disposed in first and second planes, both of which are substantially perpendicular to the fixed operable axis of the hammer, each tongue being bent toward the platen at first and second angles relative to the common plane when the first and second type members are respectively struck by the hammer in the printing position, the first angle being greater than the second angle, whereby said first and second type members are evenly impacted against said platen by said hammer.

* * * * *